US005492484A

United States Patent [19]

Archer

[11] Patent Number: 5,492,484

[45] Date of Patent: Feb. 20, 1996

[54] MULTIPLE CONNECTOR INSULATION DISPLACEMENT CONTACT

[75] Inventor: Lee A. Archer, Asheville, N.C.

[73] Assignee: Superior Modular Products Incorporated, Swannanoa, N.C.

[21] Appl. No.: 296,328

[22] Filed: Aug. 25, 1994

[51] Int. Cl.[6] ..... H01R 4/24

[52] U.S. Cl. ..... 439/395; 439/408

[58] Field of Search ..... 439/395, 406, 439/408, 887

[56] References Cited

U.S. PATENT DOCUMENTS

| | | | |
|---|---|---|---|
| Re. 32,898 | 4/1989 | Dechelette | 439/395 |
| 3,654,594 | 4/1972 | Sitzler | 439/887 X |
| 4,116,522 | 9/1978 | Reynolds | 439/408 X |
| 4,333,700 | 6/1982 | Pugh, III | 439/403 |
| 4,548,459 | 10/1985 | Mosser, III | 439/395 X |
| 4,872,849 | 10/1989 | Long | 439/395 X |

FOREIGN PATENT DOCUMENTS

| | | | |
|---|---|---|---|
| 3541371 | 5/1987 | Germany | 439/395 |
| 2130815 | 6/1984 | United Kingdom | 439/608 |

OTHER PUBLICATIONS

Krone LSA–Plus® Konnection System Publication.

*Primary Examiner*—Neil Abrams
*Assistant Examiner*—Barry Matthew L. Standig
*Attorney, Agent, or Firm*—Carter & Schnedler

[57] ABSTRACT

There is provided a bifurcated contact for terminating a pair of insulated conductors. The contact includes a pair of furcations each having first and second interconnected and interdependent resilient elements. Each first element is in the form of a loop extending into a slot formed by the second elements. The first and second elements are on different planes. The first elements include juxtaposed termination surfaces wherein a second conductor may be terminated after the termination of the first conductor without disturbing the integrity of the termination of the first conductor.

14 Claims, 2 Drawing Sheets

MULTIPLE CONNECTOR INSULATION DISPLACEMENT CONTACT

BACKGROUND OF THE INVENTION

This invention relates to insulation displacement contacts. More particularly, it relates to insulation displacement contacts which are useful in terminating more than a single conductor.

Insulation displacement contacts which terminate a single insulated conductor have been used for quite some time in the electrical connector industry. In general, an insulation displacement contact includes a bifurcated element having a pair of beams with a pair of closely spaced opposed termination surfaces. The beams separate in a V-shape, like a scissors, during termination. The termination surfaces include knife edge portions for penetrating the insulation of the electrical conductor.

An example of an insulation displacement contact is disclosed in U.S. Pat. No. 4,333,700 assigned to Bell Telephone Laboratories Incorporated.

Insulation displacement contacts are used to a large extent in 110 block housings used in the telecommunications industry with patch panels located in buildings and offices which have multi-line telephone and communication systems. Incoming wires from the telephone company are terminated by the 110 blocks located on the patch panel. Each insulation displacement contact is normally designed to terminate only a single wire or conductor. However, it is often desirable to terminate a second conductor by an insulation displacement contact.

A typical insulation displacement contact is not able to properly terminate more than a single insulated electrical conductor. If one tries to terminate a second conductor after a first conductor has been terminated and the V-shape has been formed, the integrity of the termination, i.e. conductor metal to contact metal, is often disturbed. This occurs because the contact beams are spread apart again during the termination of the second conductor, thus loosening the connection with the first conductor. The problem occurs when the conductor diameters are the same or different, however, it is exacerbated if the diameter of the second conductor is larger than the diameter of the first conductor.

There is currently on the market a contact known as the LSA-PLUS, which is commercially available from Krone, Inc., which is claimed to be able to terminate two conductors. The Krone LSA-PLUS contact is a slotted contact which is placed diagonally across the well of contact receiving housing which is modified to permit a twisting of the contact so as to continue a grip on the first terminated conductor while the second conductor is being terminated. The Krone LSA-PLUS contact requires a modification in the contact housing. In addition, the Krone LSA-PLUS contact relies on shear forces, like scissors, and has been known to cause undesirable deep nicks in the conductors.

OBJECTS OF THE INVENTION

It is therefore one object of this invention to provide an improved insulation displacement contact.

It is another object to provide an insulation displacement contact which will readily terminate more than a single conductor.

It is still another object to provide an insulation displacement contact which will terminate a second electrical conductor without disturbing the integrity of the termination of a first conductor.

It is yet another object to provide a dual wire insulation displacement contact which is usable with a standard 110 connector housing without substantial modifications to the housing.

SUMMARY OF THE INVENTION

In accordance with one form of this invention there is provided an electrical contact for terminating a pair of conductors. The contact includes first and second elongated beams connected together. A slot is formed between the beams. A first leg is connected to the first beam and extends into the slot. A second leg is connected to the second beam and also extends into the slot. The legs have elongated surfaces closely spaced and juxtaposed from one another for making contact with and thus terminating the conductors. Each leg is resilient along the elongated surface so that the act of terminating the second conductor, subsequent to the termination of the first conductor, will not substantially degrade the integrity of the termination of the first conductor.

In accordance with another form of this invention, there is provided an apparatus for terminating at least one conductor including a bifurcated contact including first and second furcations. Each furcation having first and second interconnected and interdependent resilient members. The first resilient members include conductor termination surfaces which are adjacent to one another. Upon the application on the first resilient members due to a force of the termination of a conductor, each resilient member will flex so that an amount of stress on the first resilient member is relieved by the second resilient member.

In yet another form of this invention, there is provided an insulation displacement contact including first and second cantilevered beams. A first simple beam is connected in two places to the first cantilevered beam and a second simple beam is connected in two places to the second cantilevered beam. Each of the simple beams have a termination surface juxtaposed to one another.

BRIEF DESCRIPTION OF THE DRAWINGS

The subject matter which is regarded as the invention is set forth in the appended claims. The invention itself, however, together with further objects and advantages thereof, may be better understood by reference to the following description taken in conjunction with the accompanying drawings in which:

DESCRIPTION OF THE PREFERRED EMBODIMENTS

Figure 1:
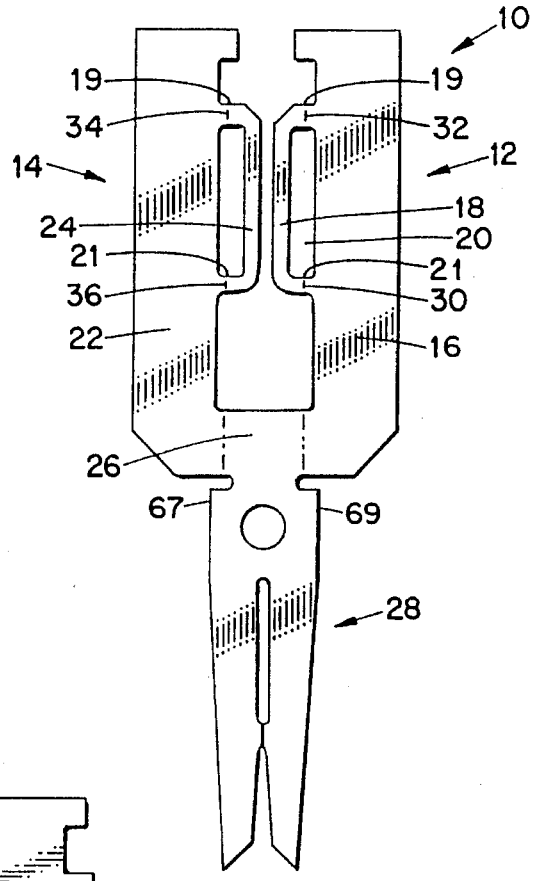
FIG. 1 is a front elevational view of the contact of the subject invention after having been stamped, but prior to the bending of the furcations.

Referring now more particularly to FIG. 1, there is provided electrical contact 10 which is shown in a planer condition immediately after stamping, but prior to bending the operation, which will be explained below. Preferably, contact 10 is made from a phosphor bronze alloy, and more preferably, it is made from a beryllium copper alloy. Contact 10 is bifurcated and includes a pair of furcations 12 and 14. Furcation 12 includes elongated cantilevered beam 16 and a simple beam in the form of C-shaped leg 18 connected thereto at two spaced apart locations 19 and 21 on the cantilevered beam. A space 20 is provided between a portion of the leg 18 and beam 16 and between the spaced apart connection points 19 and 21. Furcation 14 is identical to furcation 12 and includes cantilevered beam 22 and a simple beam in the form of C-shaped leg 24. Beams 16 and 22 are integral with one another and merge together in a middle region of the contact generally indicated as 26.

Figure 4:
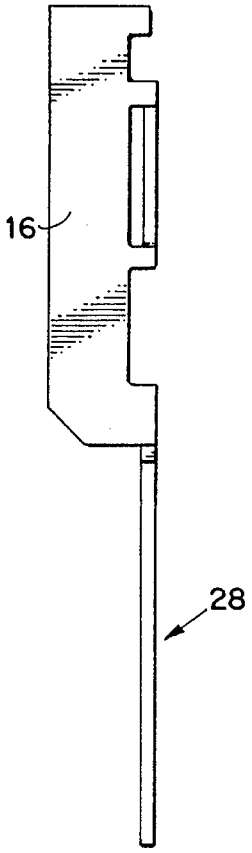
FIG. 4 is a side elevation view of the contact of FIG. 2, however, showing an alternative lower portion.

An elongated stud element 28 extends below the middle region 26. In the embodiment of FIG. 1, the major portion of stud element 28 is in the form of a standard insulation displacement contact for terminating a single conductor. In the embodiment shown in FIG. 4, the major portion of stud element 28 is in the form of a post which is to be connected to a substrate such as a printed circuit board.

Figure 2:
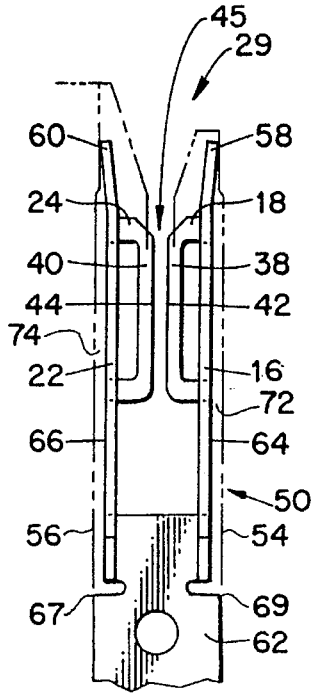
FIG. 2 is a partial front elevational view of the contact of FIG. 1 subsequent to the bending of the furcations and showing a portion of the well of the housing receiving the contact.
Figure 3:
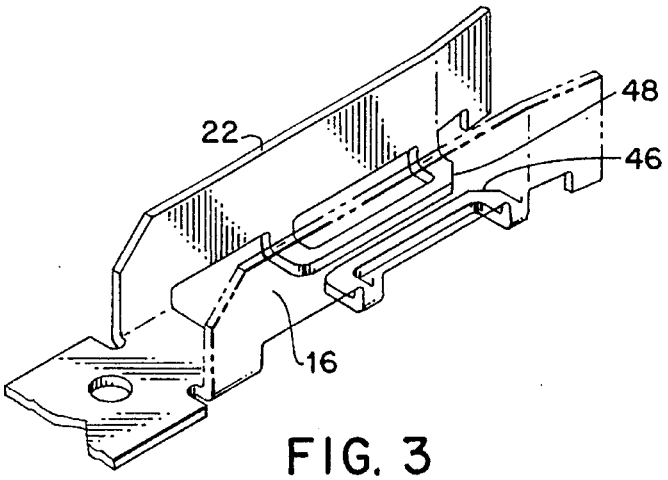
FIG. 3 is a pictorial view of the contact shown in FIG. 2.

Referring now to FIGS. 2 and 3, leg 18, and thus its major plane is bent approximately 90° with respect to beam 16, and thus its major plane. Likewise, leg 24 is bent approximately 90° with respect to beam 22. The phantom lines 30, 32, 34 and 36, shown in FIG. 1, illustrate the approximate position where the bends occur which are near the places of connection 19 and 21 between the legs and the beams. The beams 16 and 22 as illustrated in FIG. 2 are rotated 90° from their position shown in FIG. 1. After this bending operation, a slot generally indicated as 29 is formed in the contact between the beams 16 and 22.

Leg 18 includes an elongated termination portion 38 which is closely spaced and juxtaposed to the elongated termination portion 40 of leg 24. Termination portion 38 includes termination surface 42, and termination portion 40 includes termination surface 44. Preferably the distance between the termination surfaces 42 and 44 when the contact is used in a standard 110 connector for terminating wire having an outside insulated diameter of 0.035 inches and an outside conductor diameter of 0.020 inches is approximately 0.012 inches.

The C-shaped legs 18 and 24 include sharp insulation cutting edges 46 and 48 for piercing the insulation on the conductors and skinning the metal of the conductors as they are placed in slot 29 for termination.

Figure 5:
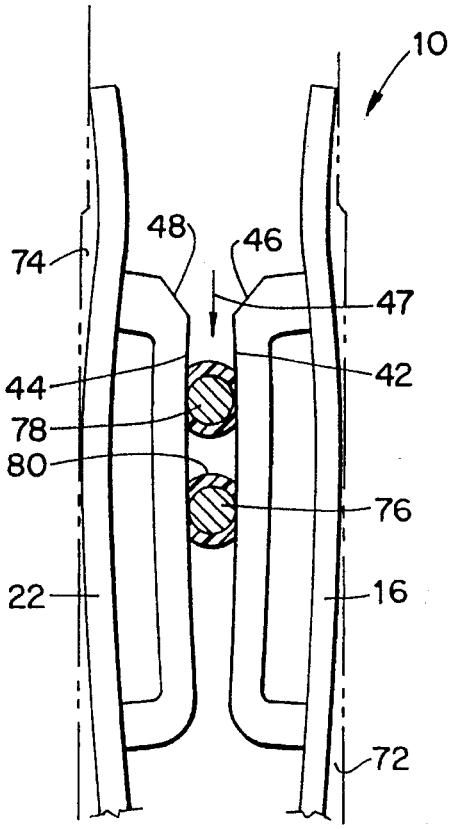
FIG. 5 is a more detailed front elevational view of a portion of the contact of FIG. 2 and showing a pair of conductors during the termination process.

The contact as illustrated in FIG. 2 is received in a contact receiving well 50 of a multi-well 110 connector block 52 which is shown in phantom in FIG. 5. Well 50 is made of plastic and includes vertical sidewalls 54 and 56. The tops 58 and 60 of beams 16 and 22 are flared outwardly so as to make contact with upper portions of sidewalls 54 and 56 respectively.

Shoulder portion 62 of the contact, which is a part of stud 28, is wider than the major portion of the distance between the outside surfaces 64 and 66 of the beams and is approximately equal to the distances between the outside surfaces of the beams at the free ends of the top bent portions 58 and 60. The outside edges 67 and 69 of shoulder portion 62 contact the walls 54 and 56 of well 50. Spaces 72 and 74 are formed between the major portions of the outside surfaces of the beams 16 and 22 and the inside surfaces of the walls 54 and 56 of the well 50. These spaces permit the beams 16 and 22 to flex outwardly as will be explained below.

Figure 6:
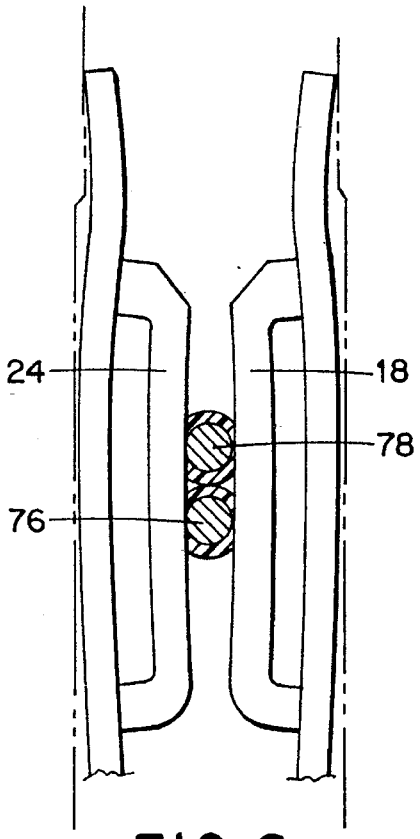
FIG. 6 is more detailed view of a portion of the contact of FIG. 5 showing the preferred position of the two conductors after termination.
Figure 7:
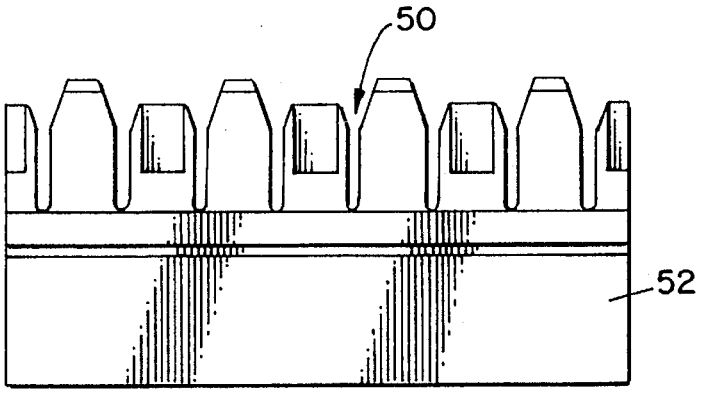
FIG. 7 is side elevational view showing a standard 110 multiple well housing for receiving a plurality of the contacts of FIG. 2.

Referring now more particularly to FIGS. 5 and 6, there is provided first conductor 76 and second conductor 78 which have been terminated by contact 10. When the first conductor 76 is passed through slot 29, portions of its insulation 80 are removed by knife edges 46 and 48 as the conductor passes between the small gap 45 which exists between the termination surfaces 42 and 44. The conductive surfaces of conductor 76, which have been skinned by knife edges 46 and 48, contact termination surfaces 42 and 44. Each termination portion 38 and 40 of the C-shaped legs 18 and 24 bows inwardly as a result of the force created during the termination. In addition, the beams 16 and 22 bow outwardly as a result of the forces transferred from the connection points 19 and 21 of the C-shaped legs to the beams 16 and 22 with the outward bow primarily occurring below spaces 72 and 74 thereby providing stress relief to legs 18 and 24.

This outwardly flexing of the cantilevered beams permit the use of a very small gap between the termination surfaces of the C-shaped legs so that very high forces are generated during termination. The stress relief provided by the outward flexing of the beams reduce the possibility of over stressing the C-shaped legs.

With the first conductor 76 having been terminated, it is pressed towards the lower portion of the gap 45. The second conductor 78 is then inserted into slot 29 and its insulation is partially removed, again by knife edges 46 and 48, and is terminated between the termination surfaces 42 and 44 slightly above the location of conductor 76. The process of similarly terminating the second conductor 78 will have substantially no effect on the integrity of the termination of conductor 76.

In fact, the process of terminating the second conductor 78 often enhances the termination of the first conductor 76. After the first conductor 76 is terminated, the legs deflect resulting in a divergence of the termination surfaces 42 and 44. When the second conductor 78 is moved through gap 45 in a direction indicated by arrow 47 shown in FIG. 5, the second conductor 78 often strikes the first conductor 76 to move further, and thus tighter, into the wedge shaped gap created by the divergence of termination surfaces 42 and 44. After this occurs, the two conductors 76 and 78 abut against one another as shown in FIG. 6.

In addition to a two wire termination contact, the above-described contact is also a superior single wire insulation displacement contact because of the ability of the beams to relieve the stress on the C-shaped legs. Therefore, a broader range of outside diameters of wires may be terminated because of this stress relief feature.

Furthermore, by using the above described contact, much lower force is required to maintain good electrical contact between the conductor(s) and the termination surfaces.

From the foregoing description of the preferred embodiment of the invention, it will be apparent that many modifications may be made therein. It would be understood therefore that this embodiment of the invention is intended as an exemplification of the invention only and that the invention is not limited thereto. It is to be understood therefore that it is intended in the appended claims to cover all modifications and equivalences which fall within the true spirit and scope of the invention.

I claim:

1. An electrical contact for terminating at least a pair of conductors comprising:

first and second elongated beams; said beams being connected together;

a slot formed between said beams;

a first leg connected to said first beam and extending into said slot;

a second leg connected to said second beam and extending into said slot;

each leg having an elongated surface for terminating the conductors; said surfaces being juxtaposed to one another;

each leg being resilient along said elongated surface whereby the act of terminating the second conductor subsequent to the termination of the first conductor will not substantially degrade the integrity of the termination of the first conductor; said first beam being in one major plane and said first leg being in another major plane; said major plane of said first beam being different from said major plane of said first leg, wherein an angle is formed between said first beam and said first leg; said second beam being in one major plane and said second leg being in another major plane; said major plane of said second beam being different from said major plane of said second leg, wherein an angle is formed between said second beam and second leg.

2. An electrical contact as set forth in claim 1, wherein each leg has a first and second end; said first end connected to one portion of said beam and said second leg connected to another portion of said beam; a space formed between said elongated surface and a portion of each of said beams located between said ends thereby enabling each of said legs to flex inwardly.

3. A contact as set forth in claim 2, wherein each of said legs are C-shaped.

4. A contact as set forth in claim 1, wherein said slot has a top opening for receiving the conductors prior to termination; a first end of each leg near said top opening of said slot; each of said first ends having a sharp edge for piercing portions of the insulation on the conductors.

5. A contact as set forth in claim 1, wherein said beams and said legs are on planes approximately 90° from one another whereby said slot is U-shaped.

6. An electrical contact for terminating at least a pair of conductors comprising:

first and second elongated beams; said beams being connected together;

a slot formed between said beams;

a first leg connected to said first beam and extending into said slot;

a second leg connected to said second beam and extending into said slot;

each leg having an elongated surface for terminating the conductors; said surfaces being juxtaposed to one another;

each leg being resilient along said elongated surface whereby the act of terminating the second conductor subsequent to the termination of the first conductor will not substantially degrade the integrity of the termination of the first conductor; said contact is adapted to be received in a housing having at least one well; said well having a pair of substantially straight side walls adjacent to said beams; top portions of said beams projecting outwardly so that said top portions make contact with said side walls of said well while certain other portions of said beams do not make contact with said sidewalls prior to the termination of said conductors, whereby portions of said beams may flex outwardly towards said walls when said conductors are terminated.

7. A contact as set forth in claim 6, further including a stud located on the lower portion of said contact; portions of said stud contacting the first and second walls of the well.

8. A contact as set forth in claim 7, wherein said stud is in the form of a post; said post adapted to be connected to a circuit board.

9. A contact as set forth in claim 7, wherein said stud is in the form of a slotted electrical contact; said slotted electrical contact adapted to terminate a third electrical conductor.

10. A contact as set forth in claim 1, wherein said contact is made of a phosphor bronze alloy.

11. A contact as set forth in claim 1, wherein said contact is made of a beryllium copper alloy.

12. An apparatus for terminating at least one conductor comprising:

a bifurcated contact including first and second furcations;

each furcation having first and second interconnected and interdependent resilient elements; said first resilient element of each furcation having a conductor termination surface; said conductor termination surfaces of each furcation being adjacent to one another, whereby upon the application of a force on said conductor termination surfaces due to the placement of a conductor between said adjacent conductor termination surfaces the first and second resilient elements of each furcation will flex wherein as portion of the stress on said first resilient element is relieved by its corresponding said second resilient element; said second resilient element of each furcation is an elongated beam; the top portion of each of said elongated beams are bent outwardly for making contact with a wall of a connector housing whereby a space is provided between the major portion of said beam and the wall of the connector housing so that said beam may flex outwardly towards the wall upon the transfer of force from said first resilient element to said second resilient element.

13. An apparatus as set forth in claim 12, wherein said first resilient element is substantially C-shaped and is connected to said second resilient element resulting in a space between said first resilient element and said second resilient element so that portions of said first resilient element may flex towards said second resilient element.

14. An apparatus as set forth in claim 13, wherein said first resilient element and said second resilient element of each furcation are on different planes.

* * * * *